US006032308A

United States Patent [19]

Chuang

[11] Patent Number: 6,032,308

[45] **Date of Patent: *Mar. 7, 2000**

[54] PROTECTIVE COMFORTER COVER BAG

[76] Inventor: Henry Chuang, 422 E. Valley Blvd., San Gabriel, Calif. 91776

[ * ] Notice: This patent issued on a continued prosecution application filed under 37 CFR 1.53(d), and is subject to the twenty year patent term provisions of 35 U.S.C. 154(a)(2).

[21] Appl. No.: 08/727,740

[22] Filed: Oct. 8, 1996

Related U.S. Application Data

[63] Continuation of application No. 08/727,740, Oct. 8, 1996, abandoned.

[51] Int. Cl.[7] ..... A47G 9/00

[52] U.S. Cl. ..... 5/502; 5/482; 5/413

[58] Field of Search ..... 5/502, 413, 485, 5/486, 494, 496, 497, 500, 501, 482; 2/69.5

[56] References Cited

U.S. PATENT DOCUMENTS

| | | | |
|---|---|---|---|
| 1,347,642 | 7/1920 | McNatt | 5/501 |
| 2,222,782 | 11/1940 | Moses | 5/500 |
| 2,516,363 | 7/1950 | Block et al. | 5/500 |
| 2,789,298 | 4/1957 | Budinquest | 5/486 |
| 3,584,323 | 6/1971 | Worley | 5/413 R |
| 4,777,681 | 10/1988 | Luck et al. | 5/502 |
| 5,005,236 | 4/1991 | Hutchinson | 5/502 |

FOREIGN PATENT DOCUMENTS

| | | | |
|---|---|---|---|
| 621371 | 6/1961 | Canada | 5/501 |
| 431558 | 2/1935 | United Kingdom | 5/413 R |
| 519243 | 10/1938 | United Kingdom | 5/502 |
| 1341960 | 9/1970 | United Kingdom | 5/413 R |

OTHER PUBLICATIONS

Journal of A.M.A. (vol. 168 No. 7) Maurice Gershman, Oct. 18, 1958.

*Primary Examiner*—Michael F. Trettel
*Assistant Examiner*—Fredrick Conley
*Attorney, Agent, or Firm*—Raymond Y. Chan; David and Raymond

[57] ABSTRACT

A protective comforter cover bag includes a rectangular bag body having a first cover sheet and a second cover sheet peripherally connected together to define an interior comforter cavity therebetween. The first cover sheet has an inlet access for placing at least a comforter piece into the comforter cavity of the cover bag. The inlet access is an U-shape opening extending along a first side, a second side and a third side of the first cover sheet of the bag body. The protective comforter cover bag further comprises a securing means and an mounting means. The securing means is positioned along the U-shape opening for shutting the inlet access. The mounting means comprises a plurality of busteners affixed to at least four corners of the bag body for firmly attaching with at least four corners of the comforter piece placed within the bag body so as to mount the comforter piece evenly spread in position.

8 Claims, 8 Drawing Sheets

PROTECTIVE COMFORTER COVER BAG

This is a Continuation Application of a continuation application filed on August 03 of an original application having a Ser. No. of 08/727,740 and a filing date of Oct. 08, 1996, now abandoned.

BACKGROUND OF THE PRESENT INVENTION

The present invention relates to comforters, and more particularly to a protective comforter cover bag which comprises a detachable outer cover bag for receiving at least a compatible inner separate piece insulation, so as to provide more convenient and senatorial bedroom maintenance.

Human being all through out the world spend pretty much one third of our life in bed, and thus it is very important for us to maintain a clean and senatorial bed. A standard bed usually would consist of a fitted sheet, a set of pillows and, to keep our body warm, a flat sheet, a blanket and a comforter. Unfortunately, all these linen would eventually collect dust, bacteria, and other health hazardive dirt particles. For most of the linens, it would be easier to maintain clean or replace, except the comforter. For example, the fitted sheet, flat sheet, all the pillow covers and the blanket can be frequently wash with our standard household washing machine to maintain senatorial, but we all know that washing the comforter would be a great hassle.

Washing the comforter bring a great deal of inconvenience. Each time the comforter goes through the washing process, the comforter would eventually be slowly destroyed and hardened by all the machine washing. Especially the life span of the delicate insulation materials within the comforter will not last very long due to the frequent moisture absorbent of our bodily fluid and frequent washing.

The comforter is usually positioned at the most outer perimeter of our bed, therefore it collects a massive amount of dust and other unpleasant dirt particle, and on top of all the daily bodily fluid absorbent. Many people often contract allergy reaction due to all the dust, bacteria and dirt particle collected on their daily use comforter. We know that without washing the comforter, it would be very unsenatorial. For many people, to solve this problem the next step to take is to purchase a new comforter when the time comes, and knowing the economically high cost of the comforter existing out in the market today, we have to find a wiser solution for this problem.

Some people try to use a washable cover bag to place the comforter therein. However, it is extremely troublesome for the user to put the comforter into the cover bag. Although such cover bag provides an opening at one side thereof, the user has to squeeze the whole big comforter into the cover bag through the opening. Afterward, another great problem comes to the user that the user is suffered by finding the four corners of the comforter within the cover bag for matching and aligning with the four corners of the cover bag.

Usually, the user must firstly find out two corners of one side of the comforter to align with two corners, near the opening, of the cover bag, and then firmly holds the comforter and the cover bag at these two corner positions and lifts the comforter as well as the cover bag up vertically for shaking until the other two corners of the comforter fall to the other bottom side of the cover bag, so as to enable the user to align the other two corners of the comforter and the cover bag respectively. According to the process as mentioned above, it is one of the reasons that most people do not will to prepare a cover bag for the comforter.

Another unacceptable great shortcoming of the combination of the comforter and the conventional cover bag is that the comforter within the cover bag may easily and usually shift aside or even curl up after over night usage. It brings a great deal of inconvenience for the user to set the comforter and the cover bag every morning.

Besides, we need to keep our comforter clean and our bed in senatorial condition, the comforter is also the thickest cover linen on our bed. However, sometimes the weather and temperature of the air vary due to the different seasons of the year, we would not be able to maintain a comfortable sleep through out the nights. Therefore, some people would prefer to purchase a plurality of separate comforters with different thickness for the use in different seasons. But it would be an extra expense to own more than two separate comforters and a hassle during storage. Also most of the comforters out in the market are not produce in good quality, because it is well known that the insulation materials within the comforter often position out of placement.

In the market today, there are many variety of comforters out in the market today, but yet not one can solve the above problem. The present invention is the solution to the above problem, it is a new design revolutionary product that can surely fulfill our need.

SUMMARY OF THE PRESENT INVENTION

The main object of the present invention is to provide a protective comforter cover bag which enables the user to set at least a comforter to spread therein easily and conveniently.

Another object of the present invention is to provide a protective comforter cover bag which enables more than one comforters evenly spread layer by layer therein without any curling up or out of placement under any condition.

Another object of the present invention is to provide a protective comforter cover bag which provides a mounting means for securing one or more comforters to maintain its or their evenly spread position within the cover bag.

Another object of the present invention is to provide a protective comforter cover bag which can prolong the life span of our comforter.

Another object of the present invention is to provide a protective comforter cover bag which can adjust the overall thickness of the comforter according to the desire of the user.

Accordingly, the present invention provides a protective comforter cover bag which comprises a rectangular bag body having a first cover sheet and a second cover sheet peripherally connected together to define an interior comforter cavity therebetween. The first cover sheet has an inlet access for placing at least a comforter piece into the comforter cavity of the cover bag. The inlet access is an U-shape opening extending along a first side, a second side and a third side of the first cover sheet of the bag body. The protective comforter cover bag further comprises a securing means and an mounting means. The securing means is positioned along the U-shape opening for closing the inlet access. The mounting means comprises a plurality of busteners affixed to at least four corners of the bag body for firmly attaching with at least four corners of the comforter piece placed within the bag body so as to mount the comforter piece evenly spread in position.

DETAILED DESCRIPTION OF THE PREFERRED EMBODIMENT

Figure 1:
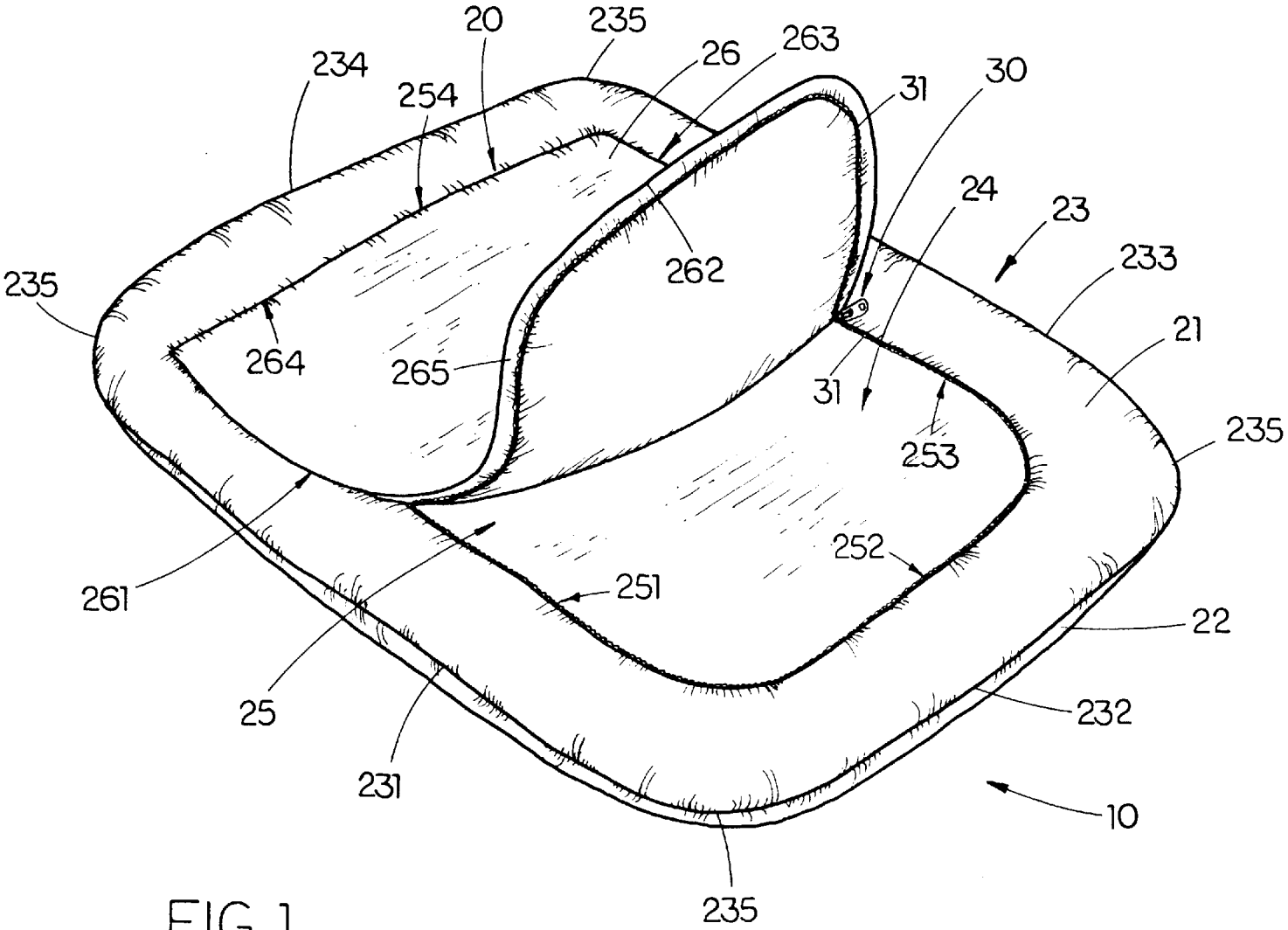
FIG. 1 is a perspective view of a protective comforter cover bag of a first preferred embodiment according to the present invention, wherein the inlet access is opened and the central cover piece is lifted up to illustrate the inlet access and the comforter cavity.

Referring to FIGS. 1 to 5, a protective comforter cover bag 10 according to a preferred embodiment of the present invention is illustrated. The protective comforter cover bag 10 comprises a generally rectangular bag body 20 which is constructed by two evenly measured sheets of cloth material, which are a first cover sheet 21 and a second cover sheet 22 facing back to back and being sewed peripherally together to form a periphery side edge 23 of the bag body 20, wherein the periphery side edge 23 has a first side 231, a second side 232, a third side 233, a fourth side 234, and four corner edges 235. Therefore the bag body 20 defines a comforter cavity 24 between the first and second cover sheets 21, 22.

The first cover sheet 21 comprises an inlet access 25 for placing at least a comforter piece 50 into the comforter cavity 24 of the bag body 20. The inlet access 25 is an U-shape opening having a first side edge 251, a second side edge 252, a third side edge 253, and a fourth side edge 254 respectively extending along the first side 231, the second side 232, the third side 233, and the fourth side 234 of the first cover sheet 21 of the bag body 20. The first cover sheet 21 further comprises a central cover piece 26 for covering the U-shape opening of the inlet access 25. The central cover piece 26 has a first edge side 261, a second edge side 262, a third edge side 263, and a fourth edge side 264, in which the fourth edge side 264 is connected with the fourth side edge 254 of the inlet access 25.

The central cover piece 26 has a size slightly larger than the size of the inlet access 25. The size of the inlet access 25 must be large enough to enable an user to easily reach and observe any interior sides 231–234 and corners 235 within the comforter cavity 24 through the inlet access 25.

The protective comforter cover bag 10 further comprises a securing means 30, which is positioned along the U-shape opening of the inlet access 25 of the bag body 20 and mounted between the cover piece 26 and the first cover sheet 21, for selectively operating the inlet access 25 to be opened or closed.

In accordance with the present embodiment, the securing means 30 comprises a zipper 31 which has a length equal to the total length of the first side edge 251, the second side edge 252 and the third side edge 253. One half of the zipper 31 is affixed by sewing along the first side edge 251, the second side edge 252 and the third side edge 253 of the inlet access 25 of the first cover sheet 21. Another half of the zipper 31 is affixed by sewing and extended adjacent to the first edge side 261, the second edge side 262 and the third edge side 263 of the cover piece 26. Therefore, the user can zip the zipper 31 to close the inlet access 25 or to open the inlet access 25 for placing the comforter piece 50 into the comforter cavity 24 of the bag body 20. Since the cover piece 26 has a size larger than the size of the inlet access 25, a cover edge 265 is formed at the periphery side edge 23 of the cover piece 26 in order to cover the zipper 31.

Figure 3:
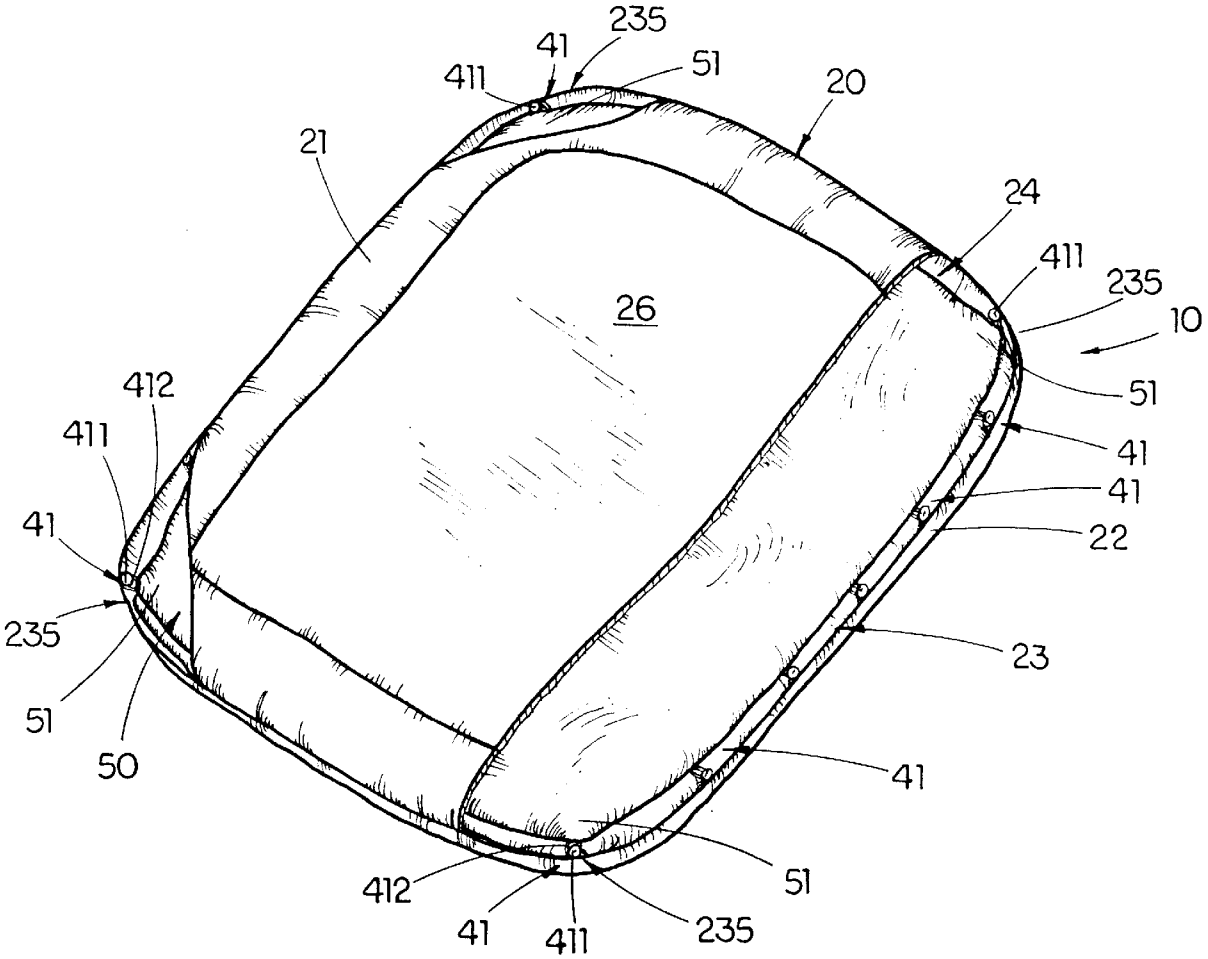
FIG. 3 is a sectional perspective view of a protective comforter cover bag of the above first preferred embodiment according to the present invention, wherein the outer protective comforter cover bag receives and mounts the comforter piece in position.
Figure 4:
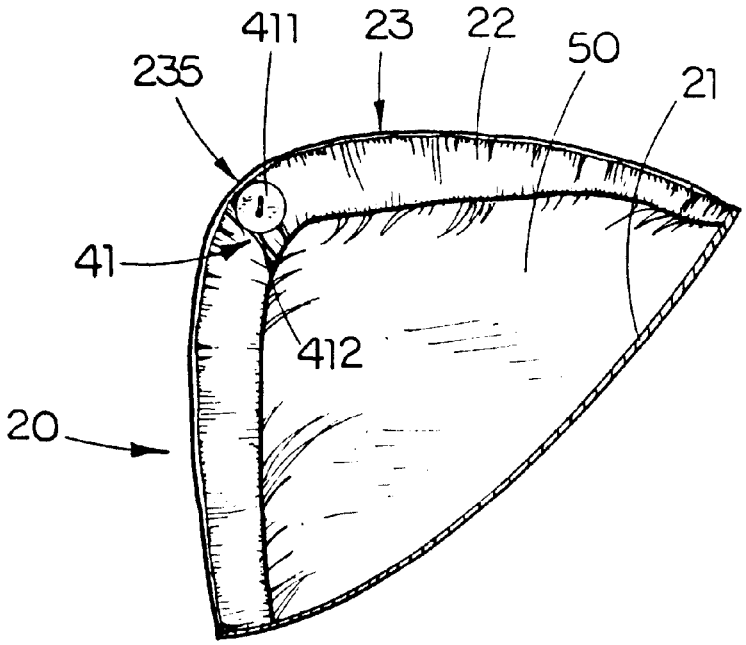
FIG. 4 is an enlarged partial sectional top view of a protective comforter cover bag of the above first preferred embodiment according to the present invention.
Figure 5:
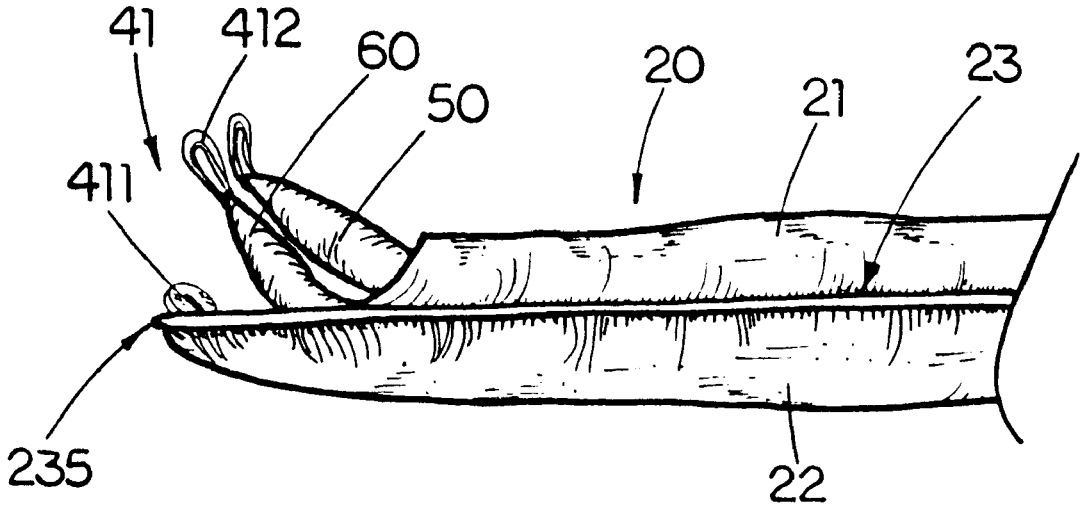
FIG. 5 is a sectional end view of a protective comforter cover bag of the above first preferred embodiment according to the present invention.

Referring to FIGS. 3 to 5, the protective comforter cover bag 10 further comprises a mounting means 40 which comprises a plurality of fasteners 41 affixed to at least four interior corner edges 235 of comforter cavity 24 of the bag body 20, as shown in FIGS. 3 to 5, adapted for firmly attaching with at least the four corners 51 of a comforter piece 50 within the comforter cavity 24 of the bag body 20 so as to mount the comforter piece 50 evenly spread in position.

Figure 2:
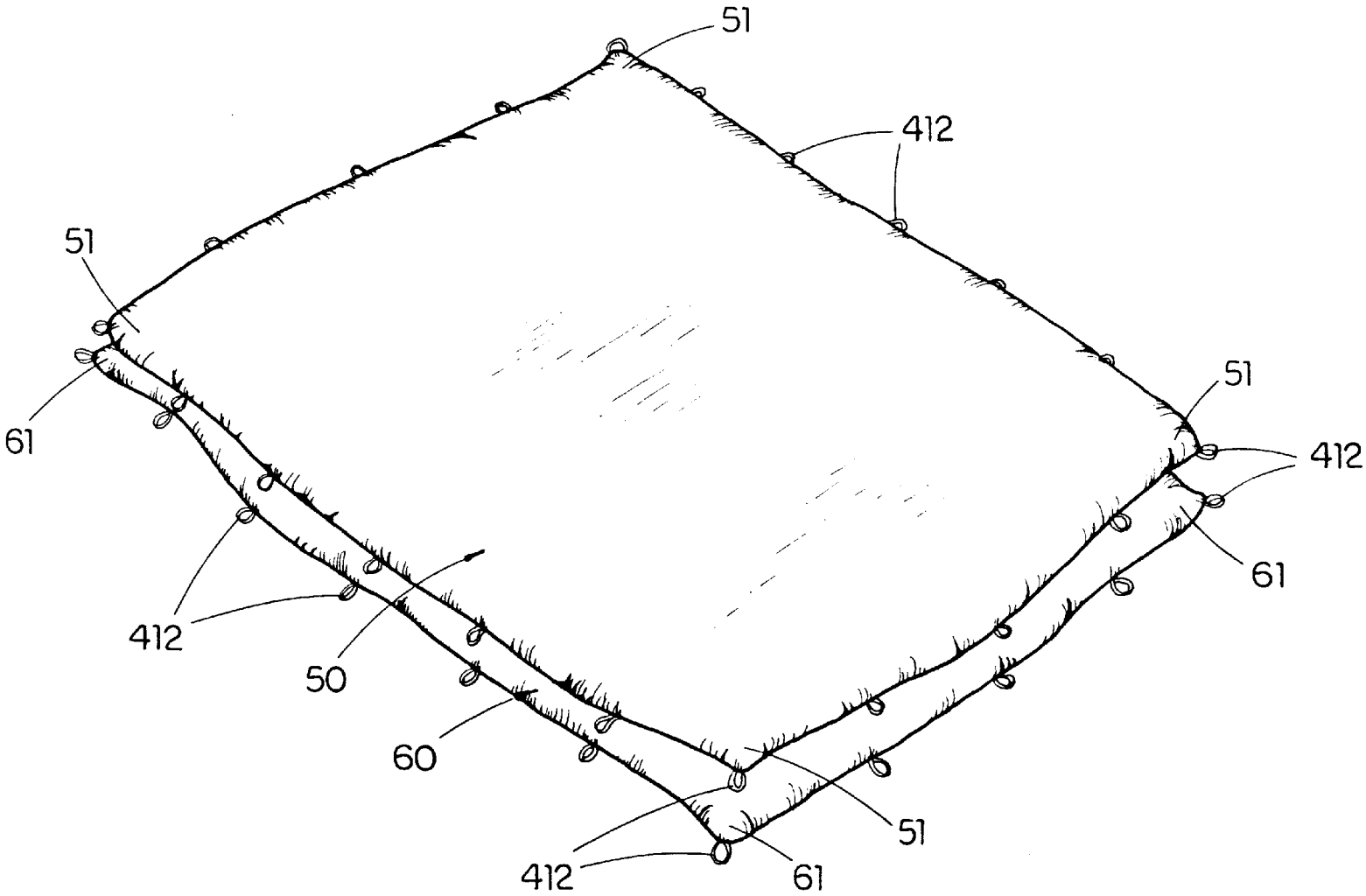
FIG. 2 is a perspective view of a protective comforter cover bag of the above first preferred embodiment according to the present invention, illustrating a plurality of connecting loops affixed along the periphery of the comforter piece.

According to the first embodiment of the present invention, each of the fasteners 41 comprises a button 411 and a loop connector 412. The plurality of buttons 411 are sewed spacedly along the interior peripheral side edge 23 (including the four corner edges 235) of the bag body 20. As shown in FIG. 2, there are a thinner comforter piece 50 and a thicker comforter piece 60. Each of the comforter pieces 50, 60 affixes a plurality of the connectors 412 spacedly along a periphery edge of the comforter piece 50 or 60 (including the four corners 51 and 61) and respective with the positions of buttons 411 mounted on the side edge 23 of the bag body 20. Each connector 412 comprises an elastic band or a strengthened strap with two ends sewed to the edge of the corresponding comforter piece 50 or 60 to form a loop-shape connector having a size slightly larger than the button 411.

To assemble the protective comforter cover bag 10 with the comforter pieces 50, 60, as shown in FIGS. 3 to 5, firstly spread the bag body 20 on a bed and then zip the zipper 31 to open the inlet access 25. Secondly, lift up the cover piece 26 so that the user can place the comforter pieces 50 and 60 one by one into the comforter cavity 24 easily through the wide opened U-shape opening of the inlet access 25. Thirdly, connect all the loop connectors 412 of the comforter pieces 50 and 60 to the corresponding buttons 411 of the bag body 20 respectively. Therefore, the comforter pieces 50, 60 are mounted evenly spread within the comforter cavity 24 of the bag body 20. Finally, zip the zipper 31 to close the inlet access 25 of the bag body 20, so that the comforter pieces 50, 60 are entirely protected within the bag body 20.

In accordance with the inlet access 25 and the securing means 30 provided in the present invention, the user can easily place and evenly spread the comforter piece 50 within the comforter cavity 24 of the bag body 20. Since the assemble of the comforter pieces 50 or 60 and the bag body 20 is fast, easy and simplified, the protective comforter cover bag 10 of the present invention is thus adapted for receiving two or more comforters. Furthermore, due to the presence of the mounting means 40, the comforter piece 50 (or even two or more comforters) is able to firmly mounted in position within the comforter cavity 24 of the bag body 20 and can be maintained in an evenly spread condition within the bag body 20 anytime. The user can easily connects the loop connectors 412 of the comforter piece 50 or 60 to the buttons 411 of the bag body 20 through the widely opened inlet access 25, as shown in FIGS. 3 and 4.

Accordingly, the user may selectively assemble one comforter, two comforters or even more than two comforters within the bag body 20 depending on the weather. In summer, the user may simply use the bag body 20 (without any comforter placed therein) as a thin cover. In spring or autumn, the user can only mount the thinner comforter piece 50 within the bag body 20. In early winter, the user can mount the thicker comforter 60 within the bag body 20 to replace the thin comforter 50. During the coldest season, the user may mount both the thin and thick comforters pieces 50 and 60 within the bag body 20 at the same time.

Figure 6:
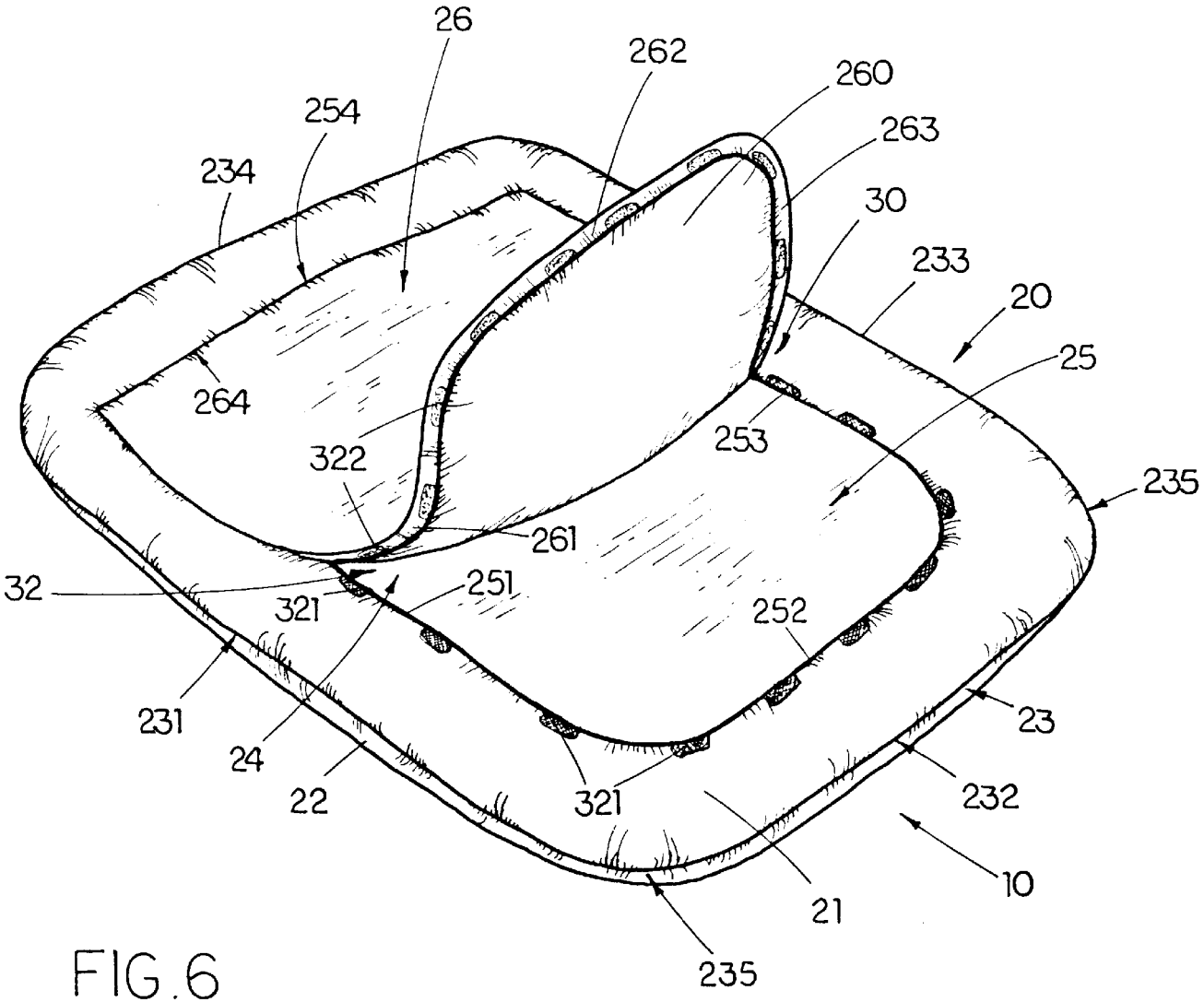
FIG. 6 is a perspective view of a protective comforter cover bag of a second preferred embodiment according to the present invention.
Figure 7:
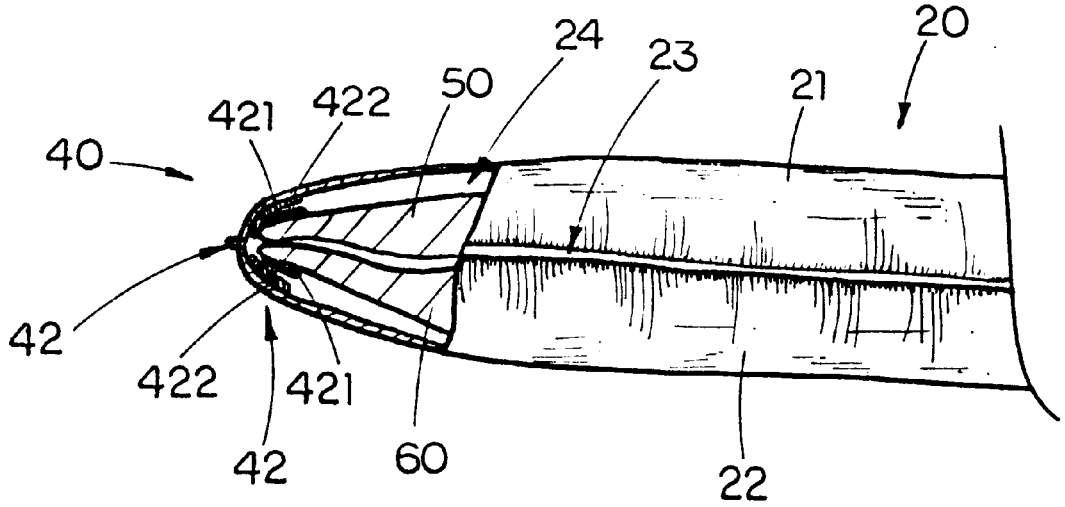
FIG. 7 is a sectional end view of a protective comforter cover bag of the above second preferred embodiment according to the present invention.

Referring to FIGS. 6 and 7, a second embodiment of the present invention is illustrated. Basically, the second embodiment has the features of the above first embodiment except the securing means 30 and the mounting means 40. According to the second embodiment, the securing means 30 comprises a plurality of hook and loop fasteners 32, which comprises a plurality of loop fastener pads 321 spacedly affixed along the first, second and third side edges 251, 252, 253 of the inlet access 25 of the first cover sheet 21 and a plurality of hook fastener pads 322, respective with the positions of the loop fastener pads 321, spacedly affixed to an inner surface 260 of the cover piece 26 along the first, second and third edge sides 261, 262 and 263 of the cover piece 26. Therefore, when the cover piece 26 is positioned to cover inlet access 25, the loop fastener pads 321 and the hook fastener pads 322 of the hook and loop fasteners 32 are firmly attached with each other for shutting the inlet access 25. In addition, when the cover piece 26 is lifted upwards, the hook fastener pads 322 will be detached from the loop fastener pads 321 so as to open the inlet access 25. In other words, the zipper 31 in the first embodiment can also be replaced by the plurality of hook and loop fasteners 32.

As shown in FIG. 7, the mounting means 40 of the second embodiment comprises a plurality of hook and loop fasteners 42. Each hook and loop fastener 42 comprises a hook fastener pad 421 and a loop fastener pad 422. The plurality of loop fastener pads 422 are affixed to an inner surface of the second cover sheet 22 spacedly along the periphery side edge 23 of the bag body 20. Also, the plurality of hoop fastener pads 421, respective with the positions of the hoops fastener pads 422, are affixed to the periphery edge of the comforter 60. Therefore piece, the comforter peice 60 is able to mounted firmly in position and maintain in evenly spread condition within the comforter cavity 24 of the bag body 20 by attaching those hook fastener pads 421 of the comforter piece 60 with the loop fastener pads 422 of the bag body 20. Moreover, as shown in FIG. 7, the first cover sheet 21 also affixes a plurality of loop fastener pads 422 spacedly along the periphery side edge 23. Accordingly, the first comforter piece 50 may also be mounted within the comforter cavity 24 of the bag body 20 by attaching a plurality of hook fastener pads 421, which are spacedly affixed along a periphery edge of the first comforter piece 50, with the loop fastener pads 422 on the first cover sheet 21. In other words, the buttons 411 and the loop connectors 412 in the first embodiment can also be replaced by the plurality of hook and loop fasteners 42.

Figure 8:
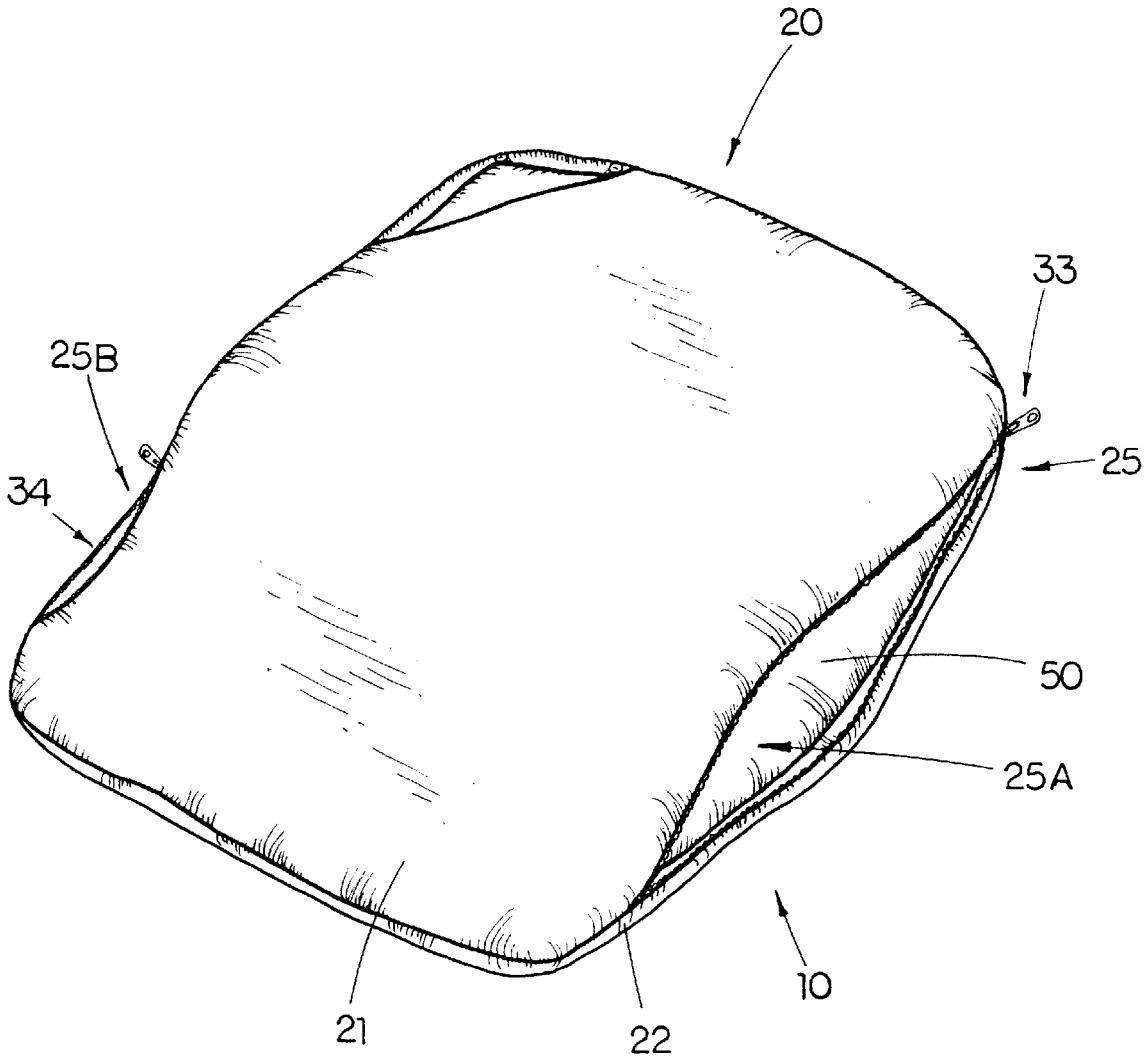
FIG. 8 is a perspective view of a protective comforter cover bag of a third preferred embodiment according to the present invention.

Referring to FIG. 8, a third embodiment of the present invention, which is a modification of the above first and second embodiments, is illustrated. In accordance with the third embodiment, the inlet access 25 of the bag body 20 has two side openings 25*a* and 25*b* which are formed at two opposite side edges of the bag body 20 respectively. Each side opening 25*a*, 25*b* has a length approximately equal to the length of the side edge of the bag body 20. Therefore, the comforter piece 50 can easily be placed between the first cover sheet 21 and the second cover sheet 22. Moreover, the securing means 30 comprises two zippers 33, 34, which are sewed to the two opposite sides of the bag body and along the two side openings 25*a*, 25*b* respectively, for selectively operating the two side openings 25*a*, 25*b* to be opened or closed.

Figure 9:
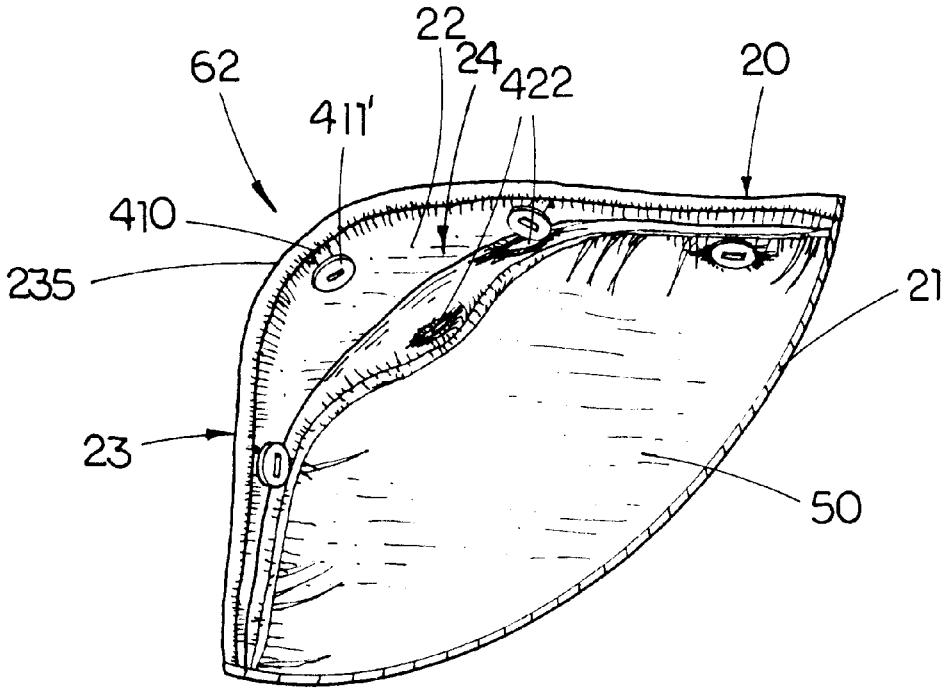
FIG. 9 is an enlarged partial sectional top view of a protective comforter cover bag of a fourth preferred embodiments according to the present invention.

As shown in FIG. 9, a fourth embodiment of the present invention, in which the fourth embodiment is basically having the same features of the above first and second embodiments except the mounting means 40 and the fasteners 41 therein. According to the fourth embodiment, each of the mounting means also comprises a button 411' and a plurality of fastener strips 410 securing the buttons 411' by the button holes thereof. The base of the predetermined fastener strip 410 is affixed to at least the four interior corner edges 235 of the comforter cavity 24 of the bag body 20. Moreover, both the thin and thick comforter pieces 50 and 60 have punctured a plurality of stud holes 422 for receiving and fastening with the buttons 411' respectively. In accordance with this fourth embodiment, the comforter pieces 50, 60 can be held more abutting against the periphery side edge 23 of the cover bag 20.

What is claimed is:

1. A protective comforter arrangement specifically for covering on top of a user, comprising:

a bag body including a first cover sheet and a second cover sheet which are facing back to back and sewed peripherally together to form a peripheral side edge of said bag body and to define a comforter cavity between said first and second cover sheets, said peripheral side edge having a first side, a second side, a third side, a fourth side, and four corner edges, wherein a U-shaped inlet access is cut on said first cover sheet to divide said first cover sheet into a central cover piece having a size smaller than that of said first cover sheet for covering a U-shaped opening and a surrounding portion extended around said central cover piece, said U-shaped opening having a size equal to that of said central cover piece, said surrounding portion having a first side edge, a second side edge, a third side edge, and a fourth side edge which are provided around said U-shaped opening and respectively extended parallel to said first side, said second side, said third side, and said fourth side of said bag body, said central cover piece having a first edge side, a second edge side, a third edge side, and a fourth edge side, wherein said fourth edge side of said central cover piece is integrally connected with said fourth side edge of said surrounding portion, and said size of said U-shaped opening is large enough for enabling the user to easily reach and observe said first, second, third, fourth sides and said four corner edges within said comforter cavity therethrough;

a securing means comprising a zipper which has a length equal to said total length of said first side edge, said second side edge and said third side edge, wherein one half of said zipper is affixed by sewing along said first side edge, said second side edge and third side edge of said surrounding portion and another half of said zipper is affixed by sewing and extended adjacent to said first edge side, said second edge side and said third edge side of said central cover piece, so as to selectively zip said two halves of said zipper together to close or to open said U-shaped inlet access;

two or more comforter pieces which are adapted to be overlappingly received inside said comforter cavity of said bag body, each of said comforter pieces having four sides;

a plurality of buttons which are affixed spacedly along said peripheral side edge within said bag body; and a plurality of loop connectors which are spacedly affixed along said four sides of each of said comforter pieces, wherein said loop connectors of each of said comforter pieces are positioned respective with said buttons affixed on said first, second, third, and fourth side edges of said bag body, each of said loop connectors comprising a strap having two ends sewed to a respective position along said four sides of each of said comforter pieces to form a loop adapted to hook on said respective button, wherein said loop connectors of one of said comforter pieces are positioned with respect to said loop connectors of said another comforter piece and tightly hooked to said buttons of said bag body respectively while said loop connectors of said another comforter piece are also tightly hooked to said buttons of said bag body respectively, so as to firmly and flatly mount said comforter pieces inside said comforter cavity of said bag body overlappingly.

2. A protective comforter arrangement, as recited in claim 1, wherein each of said loop connectors is a strengthened strap having a diameter slightly larger than that of said button.

3. A protective comforter arrangement, as recited in claim 1, wherein each of said loop connectors is an elastic band having a normal diameter smaller than a diameter of said button for firmly fastening with said button.

4. A protective comforter arrangement, as recited in claim 1, wherein said comforter pieces have different thickness.

5. A protective comforter arrangement, as recited in claim 2, wherein said comforter pieces have different thickness.

6. A protective comforter arrangement, as recited in claim 3, wherein said comforter pieces have different thickness.

7. A protective comforter arrangement specifically for covering on top of a user, comprising:

a bag body including a first cover sheet and a second cover sheet which are facing back to back and sewed peripherally together to form a peripheral side edge of said bag body and to define a comforter cavity between said first and second cover sheets, said peripheral side edge having a first side, a second side, a third side, a fourth side, and four corner edges, wherein a U-shaped inlet access is cut on said first cover sheet to divide said first cover sheet into a central cover piece having a size smaller than that of said first cover sheet for covering a U-shaped opening and a surrounding portion extended around said central cover piece, said U-shaped opening having a size equal to that of said central cover piece, said surrounding portion having a first side edge, a second side edge, a third side edge, and a fourth side edge which are provided around said U-shaped opening and respectively extended parallel to said first side, said second side, said third side, and said fourth side of said bag body, said central cover piece having a first edge side, a second edge side, a third edge side, and a fourth edge side, wherein said fourth edge side of said central cover piece is integrally connected with said fourth side edge of said surrounding portion, and said size of said U-shaped opening is large enough for enabling the user to easily reach and observe said first, second, third, fourth sides and said four corner edges within said comforter cavity therethrough;

a securing means comprising a zipper which has a length equal to said total length of said first side edge, said second side edge and said third side edge, wherein one half of said zipper is affixed by sewing along said first side edge, said second side edge and third side edge of said surrounding portion and another half of said zipper is affixed by sewing and extended adjacent to said first edge side, said second edge side and said third edge side of said central cover piece, so as to selectively zip said two halves of said zipper together to close or to open said U-shaped inlet access;

two comforter pieces which are adapted to be overlappingly received inside said comforter cavity of said bag body, each of said comforter pieces having four sides;

a plurality of loop fastener pads which are affixed to an inner surface of said second cover sheet spacedly along said periphery side edge of said bag body, wherein each of said loop fastener pads has a first side and a second side; and a plurality of hook fastener pads which are affixed to said periphery edge of said two or more comforter pieces and positioned respective with said loop fastener pads, in which each of said hook fastener pads of one of said comforter pieces is connected to said first side of said respective loop fastener pad while each of said hook fastener pads of said another comforter piece is connected to said second side of said respective loop fastener pad, so as to overlappingly and firmly mount said two comforter pieces in position and maintaining in evenly spread condition within said comforter cavity of said bag body.

8. A protective comforter arrangement, as recited in claim 7 wherein said comforter pieces have different thickness.

* * * * *